United States Patent [19]

Schulze

[11] 4,153,215

[45] May 8, 1979

[54] DEVICE FOR SEVERING AND FEEDING TO RESPECTIVE REELS A WEB OF MATERIAL WOUND IN A TURN-OVER TYPE WINDING MACHINE

[75] Inventor: Wilhelm Schulze, Kreiensen, Fed. Rep. of Germany

[73] Assignee: Maschinenbau Greene GmbH & Co KG, Kreiensen, Fed. Rep. of Germany

[21] Appl. No.: 904,553

[22] Filed: May 10, 1978

[30] Foreign Application Priority Data

Oct. 19, 1977 [DE] Fed. Rep. of Germany ..... 2746862

[51] Int. Cl.[2] ..... B65H 19/20

[52] U.S. Cl. ..... 242/56 A

[58] Field of Search ..... 242/56 A, 56 R, 64, 242/67.1 R

[56] References Cited

U.S. PATENT DOCUMENTS

| | | | |
|---|---|---|---|
| 3,345,009 | 10/1967 | Rockstrom | 242/56 A |
| 3,529,785 | 9/1970 | Mistele | 242/56 A |
| 3,752,412 | 8/1973 | Byrt | 242/56 A |
| 3,799,469 | 3/1974 | Oga | 242/56 A |
| 3,871,595 | 3/1975 | Smolderen | 242/56 A |

*Primary Examiner*—Edward J. McCarthy
*Attorney, Agent, or Firm*—Michael J. Striker

[57] ABSTRACT

The device for severing and laying on a new reel a web wound in a turn-over type winding machine having a rotary support for moving a plurality of reels about a circular path comprises a sliding carriage movable in two opposite directions relative to the circular path, a swingable contact roller arranged on the sliding carriage and operable for taking a normal working position outside the circular path in which it contacts the web being wound on a first reel and respectively a severing and laying-on position in which it contacts inside the circular path the web to be wound on a second empty reel; web severing means supported on the sliding member and including a swingable guiding roller and a swingable severing member, the guiding roller being operable to take a normal idling position outside the circular path and respectively a laying-on position in which it contacts inside the circular path the web wound on said first reel, and the severing member being operable to take a normal idling position outside the circular path and respectively a severing position inside the circular path in which it disconnects the web to be wound on the second empty reel from that being wound on the first reel.

6 Claims, 2 Drawing Figures

DEVICE FOR SEVERING AND FEEDING TO RESPECTIVE REELS A WEB OF MATERIAL WOUND IN A TURN-OVER TYPE WINDING MACHINE

BACKGROUND OF THE INVENTION

This invention relates generally to a control device for use in connection with machines for continuous winding of webs of material preferably a foil of synthetic material on a succession of reels. More particularly, this invention relates to a device for severing a continuously fed web from one reel and applying the disconnected end portion of the web to a new reel. This severing and laying-on device is applicable in turn-over type winding machines where a plurality of reels is supported for movement on a circular path and the web is guided past a contact roller pressing against the roll of the web being wound on a first reel; as soon as the windings on the first reel attain a desired diameter, and a new second reel has been moved opposite the contact roller, the latter in cooperation with an auxiliary guiding roller is displaced toward the circular path and in doing so the two rollers stretch the web around the major part of the periphery of the new second reel and the web is discontinued by the aid of a severing element that is supported for movement between the auxiliary guiding roller and the new reel In winding webs of materials such as plastic foils especially very thin and flexible plastic foils, where very high feeding speeds are involved, every increasing requirements are put on the manner how a leading portion of the web is applied to a new empty reel. Especially it is required that the newly laid-on portion of the web be free of folds since any irregularities at the beginning of the web formed of a very thin plastic foil reproduce themselves during the winding of the whole roll and may impair the quality of the foil. To avoid this drawback, a control device cooperating with the winding machine has been described and published in the German Pat. No. 2,232,338. In this prior art device a contact roller is urged against the windings of the web or against the empty reel. Due to the fact that the roller is stationarily arranged on the swing arm, it follows passively the increasing diameter of the wound web roll. In the course of the severing and laying-on process, an auxiliary guiding roller holds a winding of the advancing web portion on the empty reel so that a certain circumferential section of the empty reel is covered by the advancing web. In order to achieve a fold-free application of the new web on the empty reel, the known device has a severing element that is supported for swingable movement about the axis of the empty reel and has a surface extending concentrically with respect to the reel. A pressure air outlet is directed against the web of material and the whole structure has a form of an air box. During the severing and laying-on process the severing element together with its support moves against the web section between the auxiliary guiding roller and the reel, severs the web and introduces a new leading section of the web on the periphery of the empty reel as far as to the intake split or gap between the contact roller and the reel whereupon the lay-on process is finished. Due to the relatively small looping angle of the advancing web on the empty reel prior to the severing operation the new leading portion of the web has to travel a considerably long distance on the periphery of the reel before it reaches the intake gap between the contact roller and the reel. It is true that the prior art device by means of the above described construction of the support of the severing tool makes it possible even at high feeding speeds to attain a fold free application of the new starting section of the web. Nevertheless the disadvantage of this design resides in the necessity of additional bearings, additional drive and special construction of the support for the severing element so that considerable construction costs and operational and controlling expenditures result.

Accordingly, the primary object of this invention is to avoid the above-described disadvantages of prior art devices of this type. More particularly, an object of this invention is to provide a device which makes it possible to introduce the leading end of the web on the empty reel without forming any fold.

Another object of this invention is to provide a control device that is simple in structure and operation.

Still another object of this invention is to simplify the introduction of the web on a new reel. Furthermore, an object of this invention is to provide a device that makes it possible to increase feeding speed of the web.

SUMMARY OF THE INVENTION

In keeping with these objects and others which will become apparent hereafter, one feature of the invention resides in the provision of a control device that has a contact roller constantly in contact with the web while the latter is wound on a first reel and an auxiliary guiding roller that is normally in an idling position and is operable together with the contact roller and a severing member to be displaced past a new reel, to swing up so as to stretch the advancing web around a major surface portion of the reel the retractable severing member then discontinues the web between the auxiliary guiding roller and the full reel.

Substantial advantage of this novel arrangement resides in the fact that the contact roller in its normal winding position on a swing arm no longer remains passive during the severing and laying on process but is displaced into a position in which it maintains its pressure against the web advancing toward the new empty reel so that this position is particularly suitable for the severing and laying-on operation. In this manner any formation of folds especially of longitudinal folds is effectively prevented. The auxiliary guiding roller in this novel arrangement can be positioned with minimum spacing opposite to the contact roller, two rollers being temporarily located at the side of the reel remote from the side of feeding so that the looping angle of the web around the empty reel can approach its maximum limit and consequently the travel of the severed leading portion of the web toward the intake gap between the contact roller and the empty reel is reduced to a minimum. In other words, when the severing tool separates the web wound on the old reel in the aforementioned closest position of the contact roller and the guiding roller while the two rollers are situated at a side of the new reel remote from the side of web feeding, the above described minimum distance between the run off point and the intake gap insures that the leading edge of the web is out of contact with contact roller for a negligible amount of time during which it is carried over the minimum angular distance on the periphery of the empty reel before it is recaptured by the contact roller in the contact slit or gap between the latter and the empty reel. Consequently, due to the extremely short time period when the new web is not in contact with the contact roller, the web is always laid on the empty reel without fold because no enclosure of air by the foil can take place so that a faultless laying-on process is always insured. This favorable effect results due to the movable arrangement of the contact roller and of the guiding roller whereas the severing member is designed in conventional manner with minimum construction cost.

The arrangement of this invention provides a correct web laying process attained by simple and low cost means. Another advantage of the device of this invention is to be seen in the fact that reels having different diameters can be employed in the winding machine without the necessity of making any modifications in the control device of this invention because the various movements can be adjusted in a very simple manner to match the different diameters of the reels. Because of the common solid guiding member for the contact roller and the guiding roller and the simple and space saving structure of the severing member it is possible to achieve particularly large diameters of the wound roll of web while maintaining minimum spacing between the adjacent windings. Existing winding machines especially turn-over type winding machines can be without difficulties additionally equipped with the device of this invention. The position of the device of this invention can be easily adjusted so as to be effective for either of possible winding directions of the winding machine; for this purpose, the contact roller and the guiding roller together with the severing members are preferably constructed as a single unit that can be rotated about 180° relative to the turn-over reel carrier of the winding machine. Furthermore, due to the simple construction and operation of the device of this invention, the reel exchange rate of the winding machine can be considerably increased.

According to one embodiment of this invention the contact roller and the guiding roller are each rotatably supported on a swing arm, the two swing arms with their driving means being supported on a common sliding carriage displaceable in both directions perpendicularly to the axis of the reel. By actuating the sliding carriage to move forwardly while the respective swing arms are swung up, it is possible to displace the contact roller and the guiding roller into a severing and laying-on position in which the two rollers surround in a fork-like manner the new reel and are placed at a minimum distance from each other near the side of the reel remote from the point of feeding. This feature results in an extraordinary compact and simple construction of the device of this invention. The common support, preferably in the form of a solid sliding carriage movable perpendicularly to the reel carrier forms a structural unit supporting all functional parts of the device including individual guiding members so that the aforementioned adjustment of the device for different winding directions can be easily effected. By virtue of the arrangement of the contact and guiding rollers on swing arms supported on the sliding carriage in such a manner that the resulting carriage movement enables the rollers to take a severing and laying-on position in which the new reel is surrounded in a fork-like fashion and the web is guided in a most simple manner around the new reel to form a maximum looping angle therearound and at the same time the contact roller and the guiding roller are spaced at a minimum distance from each other and from the reel. The only inlet space that is required in the web path is that for the forward movement of the severing tool to discontinue the web section between the guiding roller and the reel. The severing member during its forward movement can approach the reel so closely as to insure a reliable transfer of the new beginning of the web into the intake slot or gap during its advance over the minute stretch between the run-off point and the intake gap.

In a preferred embodiment of the invention, the severing member that by itself is known from the prior art is arranged on a swing arm that is also arranged together with its driving members on the common sliding carriage so that a particularly simple structural and operational design of the device of this invention is attained. This design also guarantees the most accurate path of movement of the contact roller, the guiding roller and the severing member resulting in flawless wire laying function. The compactness as well as the structural and operational simplicity of the device is further enhanced by placing all remaining feeding mechanism and additional guiding rollers such as the intake roller and the width adjusting roller on the same sliding carriage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
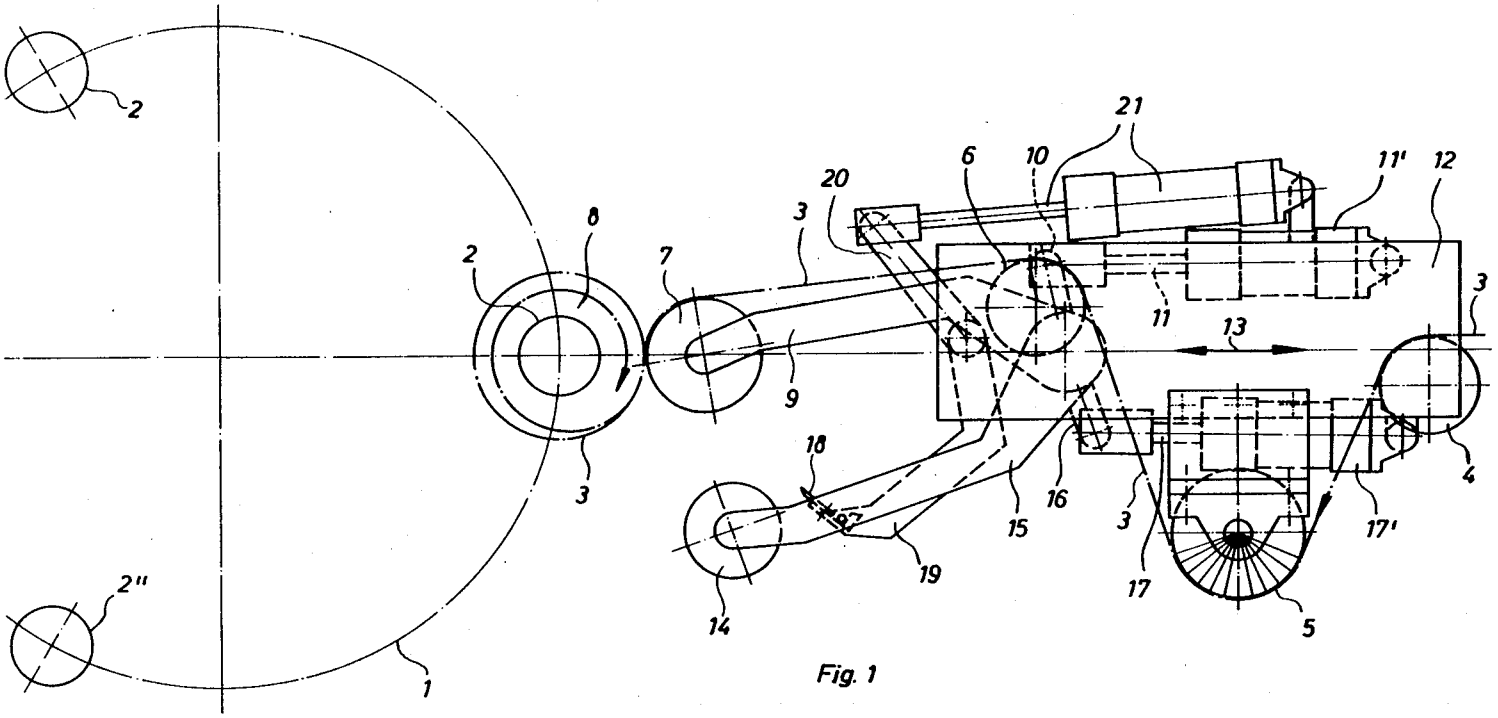
FIG. 1 shows a side view of the control device of this invention in its normal position relative to a turn-over type winding machine.

In the drawing only those component parts of the winding machine and the device of this invention are schematically illustrated that are necessary for disclosing this invention.

The winding machine has a rotary or turn-over support 1 schematically indicated by a dash and dot line that supports on its periphery a plurality of winding reels 2, 2' and 2'' and moves these reels on a circular path corresponding to the dash and dot line. The winding reel 2 as shown in FIG. 1 is in its winding position in which it winds up a web 3 of material, particularly a web formed of a plastic foil. The web 3 is fed past an inlet or intake roller 4, a width adjusting roller 5 as well as an additional guiding roller 6 and a contact roller 7. The contact roller 7 keeps pressing against the web roll 8 on the reel 2 during the whole winding process. The contact roller 7 is supported for rotation on a free end of a swing arm 9 that at its other end is coupled via a driving arm 10 to a driving mechanism consisting of a cylinder 11 and piston 11' of a hydraulic unit that controls the swinging movement of the arm 9 and thus of contact roller 7. The swing arm 9 with its driving arm 10 as well as the piston cylinder unit 11 and 11' are supported on a slidable carriage 12. The carriage 12 is movable in two opposite directions as indicated by double arrow 13 perpendicularly to the axis of the turn-over support 1.

The device of this invention further includes an auxiliary guiding roller 14 rotatably supported on the free end of a swing arm 15. The other end of the swing arm 15 is connected via driving arm 16 to a piston cylinder unit 17 and 17'. The auxiliary guiding roller 14, its swing arm 15 and driving arm 16 as well as its driving unit 17 and 17' are also arranged and supported on the sliding carriage 12. The guiding roller 14 with its swing arm forms together with the contact roller 7 and its swing arm 9 a fork-like configuration the function of which will be explained below.

The device is further provided with a severing member 18 extending over the entire width of the web. The severing member 18 is secured to a free end of a swing arm 19 arranged together with driving arm 20 and piston and cylinder driving unit 21 on the sliding carriage 12. In the preferred embodiment of this invention, the previously mentioned feeding members, namely the intake roller 4, the width adjusting roller 5 and the web guiding roller 6 are also arranged on the common sliding carriage 12.

During the winding process the auxiliary guiding roller 14 is in its normal or idling position out of engagement with the web 3, as illustrated in FIG. 1.

Figure 2:
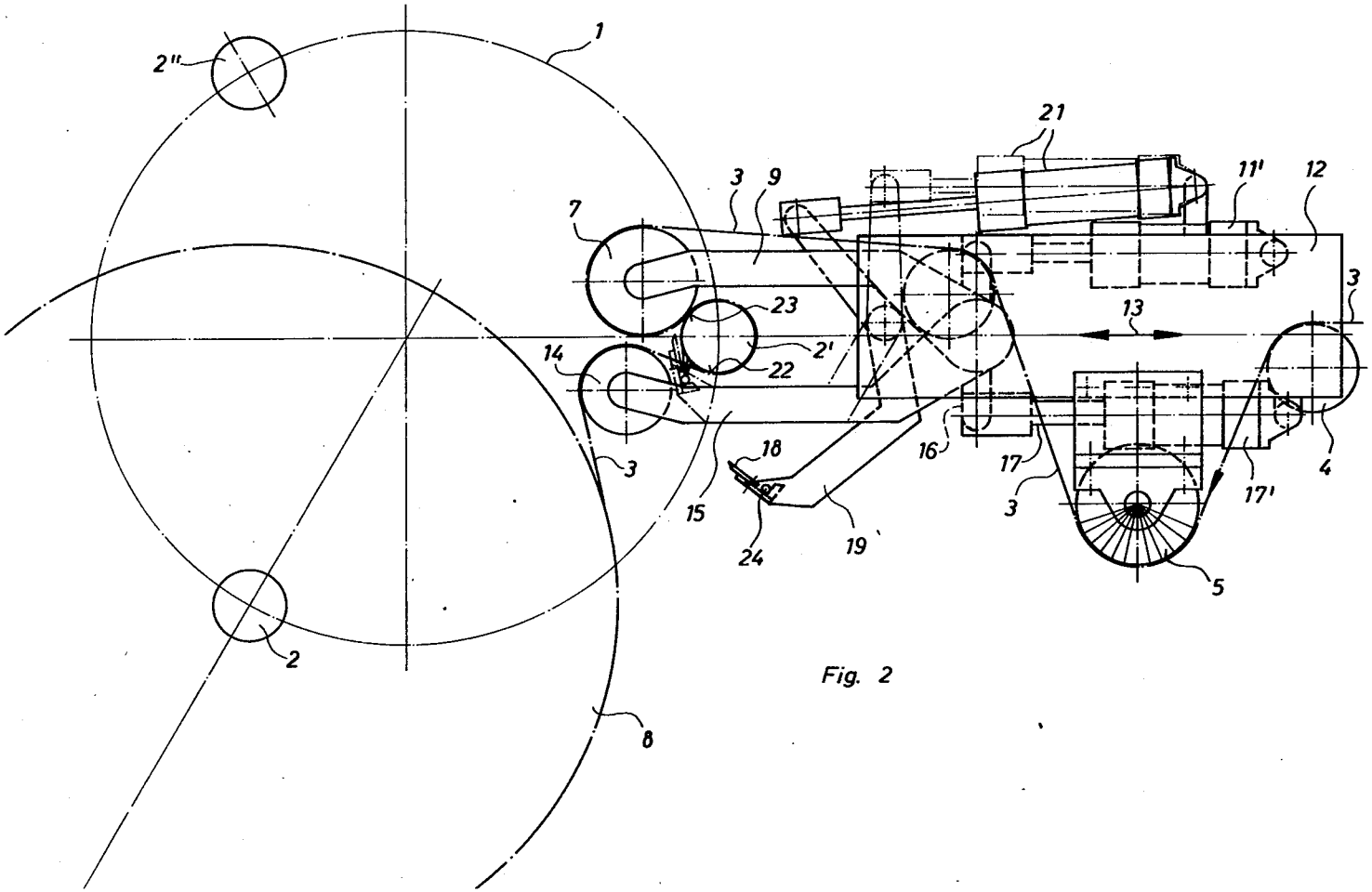
FIG. 2 is a side view of the device of FIG. 1 in its severing and laying-on position.

FIG. 2 shows the device of this invention in its actuated position in which it is ready for severing the web 3 and for applying in orderly manner the end portion of the cut-off web on a new reel 2'. While the completed web roll 8 on reel 2 has attained at least approximately a predetermined diameter, the turnover carrier 1 has displaced in a known manner a new reel 2' to a position opposite the sliding carriage 12 whereas the old reel 2 with the wound-up web roll 8 is displaced on the circular path of the carrier 1 away from the carriage 12 as seen in FIG. 2. In this position the severing operation as well as the laying-on operation can be initiated. The swing arms 9 and 15 are actuated to swing up so as to embrace the new reel 2' and at the same time the sliding carriage 12 is moved to the left. The contact roller 7 remains in contact with the web 3 and stretches the same into the area delimited by the circular path of the reel carrier 1. Similarly, the guiding roller 14 is now brought into contact with the web section between the wound-up roll 8 and the new reel 2' and stretches this section into the area delimited by the circular path of reel carrier 1. In this manner the web section between the contact roller 7 and the guiding roller 14 is laid around the major section of the circumference of the new reel 2' and the severing operation can be initiated. The contact roller 7 and the guiding roller 14 are brought as closely to each other as possible with respect to the free movement of the web 3 whereas the distance of the guiding roller 14 from the new reel 22 is limited only by the space or distance necessary for permitting the movement of the severing member 18. As can be seen clearly from FIG. 2, the fork-like surrounding of the new reel 2' by the rollers 7 and 14 makes the distance between the run off point 22 and the intake slit or gap 23 formed by the contact roller and the reel, extremely short so that practically no folding of the new laid web can take place. The swing arm 19 is actuated via the driving arm 20 actuated by a cylinder-and-piston driving unit 21 to swing up from its normal free position into a severing position as indicated by dash-and-point line in FIG. 2 in which position the web is severed in the space between the guiding roller 14 and the new reel 2'. Simultaneously, after the severing of the web the resulting front edge of the new leading portion of the web 3 is laid on the reel 2' and transported to the intake gap or slit 23 so that the winding process can continue on the new reel 2' without interrupting the advance of the web 3. As soon as the new winding has been formed the device according to this invention is actuated to resume its normal position. To this end, respective driving units 11, 17, 21 angularly displace the assigned swing arms 9, 15 and 20 back to their normal positions shown in FIG. 1 while the sliding carriage 12 returns to the right. As mentioned previously, the contact roller 7 remains in constant abutment against the newly wound web windings laid on the reel 2'.

To assist in laying-on the new beginning of the web on the new reel 2', the severing member 18 can be provided with a pressure air nozzle 24 that in a known manner directs jets of pressurized air against the new web portion on the reel 2' when the severing member 18 is in action in the position as indicated by dash-dot lines in FIG. 2.

The arrangement of all component parts of the device on a common sliding carriage 12 makes it possible to angularly displace the whole device about 180° around the axis of the turn-over carrier 1 so that the reverse position enables to control the winding of the web 3 on the reels from the opposite direction.

While the invention has been illustrated and described as embodied in a specific embodiment of the severing and laying on device of this invention, it is not intended to be limited to the details shown, since various modifications and structural changes may be made without departing in any way from the spirit of this invention.

What is claimed as new and desired to be protected by Letters Patent is set forth in the appended claims:

1. A device for severing and applying on a reel a continuous web of material wound in a winding machine having means for carrying and moving on a circular path a plurality of reels, comprising in combination: a support displaceable in two opposite directions relative to said circular path; web guiding means arranged on said support, said guiding means including a pivotably supported contact roller normally disposed outside said circular path in contact with the web roll wound on said reel; web transferring means arranged on said support and including a pivotably supported guiding roller and a pivotably supported severing member, said transferring means being normally disposed outside said circular path and out of contact with said web, said contact roller and said guiding roller being operable to move past an empty reel into a web transfer position in which the guiding roller and the contact roller are spaced apart a minute distance from each other and said guiding roller stretches the web between the full reel and the empty reel; and said severing member being operable to sever the web section between said guiding roller and said new reel whereby the resulting free front edge of the web remains on the empty reel and is transferred to an intake slit between the contact roller and the empty reel.

2. A device as defined in claim 1 wherein said supporting means is a sliding carriage, said contact roller and said guiding roller being respectively supported on a free end of a swing arm, said swing arms being supported on said sliding carriage, to form a fork-like mechanism operable to surround from two opposite sides said empty reel.

3. A device as defined in claim 2 wherein said severing member is supported on a swing arm arranged on said sliding carriage.

4. A device as defined in claim 3 wherein the driving means for said swing arms and the web feeding means are arranged on said sliding carriage.

5. A device as defined in claim 4 wherein said severing member is provided with a pressure air nozzle to assist in laying the severed web on said reel.

6. A device as defined in claim 1 further including means for angularly displacing said supporting means about 180° when the direction of winding in said machine is changed.

* * * * *